US009062498B2

(12) United States Patent
Potter et al.

(10) Patent No.: US 9,062,498 B2
(45) Date of Patent: Jun. 23, 2015

(54) RISERLESS, POLLUTIONLESS DRILLING SYSTEM

(75) Inventors: Paul Anthony Potter, Montefiascone (IT); Svein Gleditsch, Harstad (NO)

(73) Assignee: Ocean Riser Systems AS, Oslo (NO)

( * ) Notice: Subject to any disclaimer, the term of this patent is extended or adjusted under 35 U.S.C. 154(b) by 237 days.

(21) Appl. No.: 13/812,977

(22) PCT Filed: Jul. 29, 2011

(86) PCT No.: PCT/NO2011/000216

§ 371 (c)(1),
(2), (4) Date: Jan. 29, 2013

(87) PCT Pub. No.: WO2012/015315

PCT Pub. Date: Feb. 2, 2012

(65) Prior Publication Data

US 2013/0126182 A1 May 23, 2013

(30) Foreign Application Priority Data

Jul. 30, 2010 (NO) ..... 20101087

(51) Int. Cl.

| | |
|---|---|
| ***E21B 7/12*** | (2006.01) |
| ***E21B 7/128*** | (2006.01) |
| ***E21B 21/00*** | (2006.01) |
| ***E21B 21/08*** | (2006.01) |
| ***E21B 33/064*** | (2006.01) |
| ***E21B 33/08*** | (2006.01) |

(52) U.S. Cl.

CPC . *E21B 7/12* (2013.01); *E21B 7/128* (2013.01); *E21B 21/001* (2013.01); *E21B 21/08* (2013.01); *E21B 33/064* (2013.01); *E21B 33/085* (2013.01)

(58) Field of Classification Search

USPC ..... 166/337, 338, 344, 347, 358, 363, 364, 166/368; 175/5, 7, 10

See application file for complete search history.

(56) References Cited

U.S. PATENT DOCUMENTS

| | | | | |
|---|---|---|---|---|
| 2,955,753 | A * | 10/1960 | O'Conor et al. | 494/5 |
| 3,252,528 | A * | 5/1966 | Nicolson | 166/352 |
| 3,825,065 | A * | 7/1974 | Lloyd et al. | 166/351 |
| 4,149,603 | A * | 4/1979 | Arnold | 175/7 |
| 4,813,495 | A * | 3/1989 | Leach | 175/6 |
| 6,142,236 | A | 11/2000 | Brammer et al. | |
| 6,216,799 | B1 * | 4/2001 | Gonzalez | 175/5 |

(Continued)

OTHER PUBLICATIONS

PCT Search Report for PCT Application No. PCT/NO2011/000216, Oct. 27, 2011, 9 pages.

Norwegian Search Report dated Feb. 28, 2011 of Patent Application No. 20101087 filed Jul. 30, 2010, 2 pages.

(Continued)

*Primary Examiner* — James G Sayre

(74) *Attorney, Agent, or Firm* — Maine Cernota & Rardin

(57) ABSTRACT

The invention provides a drilling system for drilling subsea wells from a floating mobile offshore drilling unit (MODU), the system comprising a subsea BOP. The system is distinctive in that the subsea BOP has relative small weight and size, the system includes no marine riser but the system comprises: flexible choke and kill lines arranged between the subsea BOP and the MODU, means for drill string guidance and cleaning, for guiding when inserting or taking out a drill string from the BOP and for drill string cleaning when pulling the drill string out from the BOP, means for controlled leakage of seawater into a recovery funnel arranged below the means for drill string cleaning but above the BOP, and means for return from the recovery funnel to the MODU of drilling fluid and seawater leaked into the recovery funnel.

4 Claims, 7 Drawing Sheets

(56) References Cited

U.S. PATENT DOCUMENTS

| | | | | |
|---|---|---|---|---|
| 6,230,824 | B1 | 5/2001 | Peterman et al. | |
| 2004/0238177 | A1* | 12/2004 | Fossli | 166/364 |
| 2007/0215218 | A1* | 9/2007 | Stave | 137/544 |
| 2008/0190663 | A1* | 8/2008 | Stave | 175/7 |
| 2008/0296062 | A1* | 12/2008 | Horton, III et al. | 175/5 |

OTHER PUBLICATIONS

Deepwater Riserless Mud Return System for Dual Gradient Tophole Drilling, SPE/IADC 130308, Managed Pressure Drilling and Underbalanced Operations Conference and Exhibition held in Kuala Lumpur, Malaysia, 22 pages, Feb. 24-25, 2010.

* cited by examiner

RISERLESS, POLLUTIONLESS DRILLING SYSTEM

RELATED APPLICATIONS

This application is a US National Phase Application filed under 35 USC 371 of PCT Application No. PCT/NO2011/000216, filed 29 Jul. 2011, which claims the benefit of Norwegian Application No. NO 20101087, filed 30 Jul. 2010. Each of these applications is herein incorporated by reference in their entirety for all purposes.

FIELD OF THE INVENTION

The present invention relates to drilling offshore for petroleum to reservoirs located subsea, whereby the drilling takes place from a floating mobile offshore drilling unit, a so called MODU. With the present invention several of the problems associated with such drilling activities are mitigated or eliminated, as will be explained below.

BACKGROUND OF THE INVENTION AND PRIOR ART

In offshore drilling, there is an increasing demand for prolonged service life of the well assembly or equipment and also there is a demand for reduced or eliminated pollution to sea from the drilling activities and reduced equipment weight and cost. In addition, increased versatility of the well assembly or equipment is desirable.

So far there is no good solution for having, in combination, increased service life and versatility as well as no pollution/discharge from the drilling activities.

All drilling operations today from floating MODUs are using a marine riser connecting the MODU with the subsea blow out preventer, BOP. The marine riser has several functions, namely to serve as a return conduit for drilling fluid coming from well, to be used for attachment of rigid choke and kill lines that must be in place between the subsea BOP and the MODU for well control use, to bring the subsea BOP to/from the wellhead on the seabed, and to avoid pollution during drilling. Without a marine riser and where the wellbore is completely open to seawater, there would be pollution of mud/drilling fluids when tubulars are pulled from the drilling mud environment inside the bop and out to the seawater outside. When using of oil based mud (OBM) there will be an interface fraction heavily contaminated with seawater which could be sucked into the mud system when drilling mud is pumped back to the MODU.

Accordingly no drilling is currently attempted from a MODU without the use of a marine riser in order to control the drilling fluid and the hydrostatic head inside the borehole. Further, the modern generation MODU's are built for large water depths and are expensive to operate requiring a high day rate. In order to reduce risk of downtime related to the subsea BOP systems, there are more and more contingencies built into the BOPs itself, such as more BOP closure rams, resulting in taller and much heavier BOP's than before.

Maximum subsea wellhead loading regimes are produced when a subsea drilling BOP stack is installed on top of a production xmastree which in turn is installed on a producing well wellhead. The marine riser is connected to the BOP, causing additional horizontal loading/bending moment to the top of the BOP. In this situation, the wellhead loading regime is at its most severe and imposed bending stress and strains imposed on subsea high pressure wellhead housings are at their highest values.

However, typical subsea wellhead systems were designed for lighter equipment and shorter service life, not foreseeing heavier equipment and extended operation modes. Currently many of the installed wellheads with their xmas trees are heavily overstressed due to prolonged drilling and completion time, making it in many cases risky to connect to them with conventional heavy BOPs and marine drilling riser systems. The risk of total loss of barriers and heavy pollution is then increased. The marine riser with its horizontal and lateral forces increases the stressed loads on wellheads.

The closest prior art documents are as follows: SPE/IAD 130308 Deepwater Riserless Mud Return System for Dual Gradient Tophole Drilling, which merely relates to tophole drilling, US 2008/190663 A1, US 2008/190663 A1, U.S. Pat. No. 6,230,824, all of which are only of minor relevance, including no teaching helping the person of ordinary skill in the art to solve the well control, overstress/fatigue and pollution problems associated with drilling a complete subsea well from a floating MODU.

Other riserless drilling concepts have been proposed, such as described in publications U.S. Pat. Nos. 6,648,081 and 6,415,877, however introducing a subsea rotating control device (RCD) or a rotating BOP (RBOP) on top of the subsea BOP, which permanently is closed around the drillpipe creating a pressure tight barrier between the seawater (pressure) and the wellbore below. The outlet from the wellbore to the pump system is here below the BOP on the wellbore annulus. Such device (RCD) or R BOP have a finite life span and are subject to frequent failure due to wear during drilling and tripping. Having to change these elements in deep waters has huge associated costs and well control risks. Also it is unknown what to do with the contaminated mud/seawater fluids during such operations. Tripping out of the well with casings, drillpipe, completion strings, etc, is therefore not recommended or possible.

SUMMARY OF THE INVENTION

The invention provides a drilling system for drilling subsea wells from a floating mobile offshore drilling unit (MODU), the system comprising a subsea BOP.

The system is distinctive in that the subsea BOP has relative small weight and size, the system includes no marine riser but the system comprises:

- flexible choke and kill lines, flexible for at least a part of their lengths, arranged between the subsea BOP and the MODU,
- means for drill string guidance and cleaning, for guiding when inserting or taking out a drill string from the BOP and for drill string cleaning when pulling the drill string out from the BOP,
- means for controlled leakage of seawater into a recovery funnel arranged below the means for drill string cleaning but above the BOP, and
- means for return from the recovery funnel to the MODU of drilling fluid and seawater leaked into the recovery funnel.

Preferable embodiments of the invention are as defined in the dependent claims or described or illustrated, in any operative combination. This also includes methods and uses obvious for the person of ordinary skill in the art from studying the present disclosure.

The system of the invention enables safe intervention on already overstressed production wellheads with xmas trees. It reduces the risk of heavy pollution considerably with a lighter and less stressed BOP top (no riser connected with horizontal stress loading. Less height and weight of BOP give less stress component to the wellhead). No flexjoint or riser adapter lowers the height of the BOP. And the system of the invention provides conventional well control using flexible choke and kill lines.

Accordingly a no pollution/discharge drilling system is enabled for drilling riserless using a floating MODU. Drilling with a lightweight BOP enables smaller MODUS to drill resulting in a considerably lower day rate.

Some alternative definitions of embodiments of the invention or features thereof are as follows:

1) A riserless drilling system comprising a MODU, a riserless blowout preventer stack, a subsea pumping system with a zero pollution system and flexible interconnecting lines.
2) A riserless drilling system that uses a mud return line and a subsea booster pump to pump the mud from the wellbore back to the MODU and hence eliminate the marine riser thereby reducing the mud volume requirement for the MODU.
3) A riserless drilling system that provides enhanced well kick detection with a clear and distinct interphase between the mud and seawater and thereby subsequent control of the fluid barrier (well integrity) by the combined use of a drilling fluid recovery funnel and a utility/wiper frame for exact controlling the volume of drilling fluid from the borehole.
4) A riserless drilling system that utilizes redundant flow paths to the subsea pump to ensure a seafloor dual gradient interface at all times.
5) A riserless drilling system whereupon a utility/wiper frame is installed to serve multiple tasks, namely in the first instance, the frame located near the top of the riserless blowout preventer stack for guiding of tubulars and bottomhole assemblies into the BOP bore, secondly the frame will be located approximately at the mid point of the water column to stabilize the drill string whilst drilling in the absence of the marine drilling riser and thirdly, to accommodate a tubular wiper assembly which will be deployed into the top of the mud recovery funnel on top of the riserless BOP.
6) A riserless drilling system whereupon a utility/wiper frame, located in the top of the drilling fluid recovery funnel, effectively minimizes contamination of seawater in the immediate vicinity of the drilling fluid/seawater hydraulic de-coupler (interface).
7) A riserless drilling system with a zero pollution system where a pump is utilized to 'evacuate' contaminated seawater from the upper portion of the drilling fluid recovery funnel and discharge that fluid to the drilling unit MODU for treatment.
8) A riserless drilling system using both tensioned, potentially now utilizing the MODUs now redundant riser tensioners and non tensioned flexible choke and kill lines between the drilling unit MODU and the riserless blowout preventer stack by way of a reverse compliant wave.

The technical and economical effect of the invention is very significant. A typical BOP weights from 350 to 450 metric tons, in addition comes the riser system weighting about 200-1000 metric tons typically, depending on water depth. The system of the invention may use a BOP weighting far less, from about 150-170 metric tons, and no marine drilling riser. The cost saving in the system equipment will be significant. The very much reduced weight implies that a smaller drilling unit can be used, resulting in significant day rate savings. In addition comes the effect of prolonged service life of both new and existing subsea wellhead systems, less mud costs and expanded modes of operation not previously possible. Also the effect of no pollution and increased well safety must be taken into account.

FIGURES

The invention is illustrated with figures, of which:

DETAILED DESCRIPTION

Reference is made to the figures.

Figure 1:
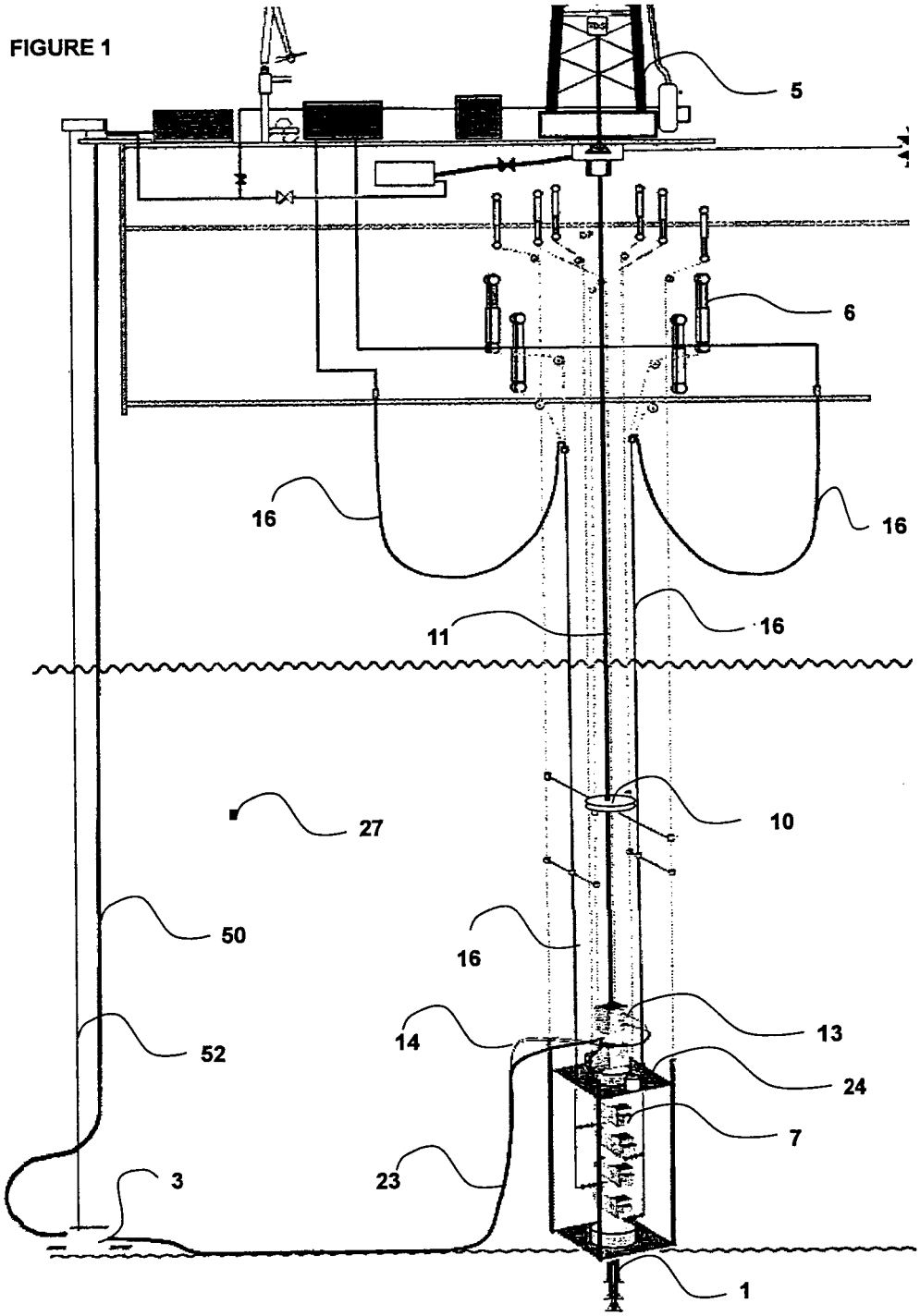
FIG. 1 shows a simplified schematic where the wellcontrol choke and kill lines are flexible and top tensioned by the conventional riser tensioning system on the drilling unit MODU.

FIG. 1 (not to scale) shows a simplified schematic of the first embodiment of the invention. A drilling unit MODU (5) is shown, with a drill string (11) deployed subsea and into the well being drilled in seawater (27). The drilling unit MODU (5) maintains its location over the well co-ordinates. On the subsea wellhead (1), a riserless blowout preventer stack (7) with a simplified LRMP on top is installed which provides secondary well control capability and renders physical connection to the subsea booster pump (3) package. The physical connection between the riserless blowout preventer stack (7) (LMRP) and the subsea booster pump (3) package is via flexible umbilicals.

The services required for the subsea booster pump (3) package and the riserless blowout preventer stack (7) are connected to the drilling unit MODU (5) by a vertical (possibly composite) hose bundle (52) connected between the seafloor or subsea free hanging installed subsea booster pump (3) module and the topsides MODU (5). The vertical composite hose bundle (52) also accommodates a drilling fluid return hose (50) and the zero pollution return conduit. In this figure the discrete flexible choke and kill lines (16) are securely terminated on to the lower marine riser package (LMRP) receiver plate (24) and are kept in tension by the use the MODU's marine riser tensioning system (6) on the drilling unit MODU (5). Vertical displacement of the drilling unit MODU (5) due to rig heave are compensated by the surface marine riser tensioning system (6) holding the flexible choke and kill lines (16) in tension and the drape catenary loops provided in the moonpool upstream of the drilling unit MODU (5) rigid pipework interface (to the choke and kill manifold)

A zero pollution system (14) is connected to the drilling fluid recovery funnel (13). The utility/guide frame (10) is first used as shown in a drilling tubular guiding position and later interfacing the drilling fluid recovery funnel (13) in order to act as part of a zero pollution device (14)

The drilling fluid recovery funnel (13) is connected to the drilling fluid booster pump (3) by a drilling fluid suction hose (23) and by a zero pollution system (14)

Figure 2:
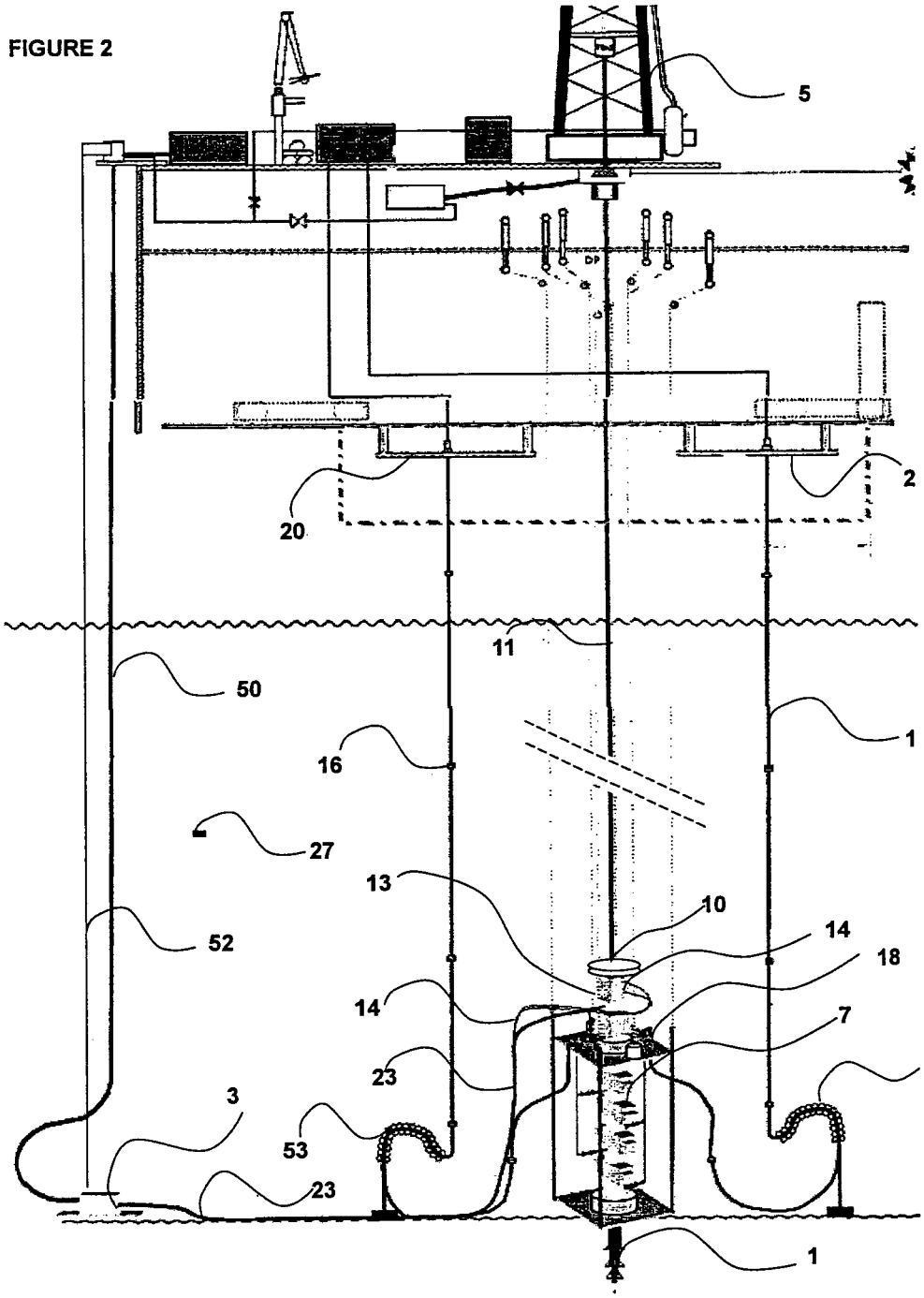
FIG. 2 shows a simplified schematic where the wellcontrol choke and kill lines are flexible and not toptensioned using heave accommodating line arrangement near the seabed and the riserless blowout preventer stack.

FIG. 2 (not to scale) shows a simplified schematic of the second embodiment of the invention and uses the same sub components as the former arrangement described in FIG. 1, however in this case, the flexible choke and kill lines (16) are not top tensioned and instead, vertical displacements of the drilling unit MODU (5), under the influence of prevailing sea states, are accommodated by a 'reverse pliant' wave (53) formed by the over length flexible pipe in near proximity to the seafloor. The flexible choke and kill lines (16) are terminated on the lower marine riser package receiver plate (18) using gooseneck assemblies (54). The length of flexible choke and kill lines (16) can be built and pre-installed prior to the commencement of a drilling campaign and thereafter remain in-situ. The sections of flexible choke and kill line (16) will be assembled individually and the increasing built length hung on supplementary basement decks (20). Such a hang-off and storage amenity will be fully used whenever the riserless blowout preventer stack (7) is on surface and moved to its parking position in the BOP Handling System. Such an arrangement facilitates full periodical pressure integrity testing during all phase of the drilling operation.

Figure 3:
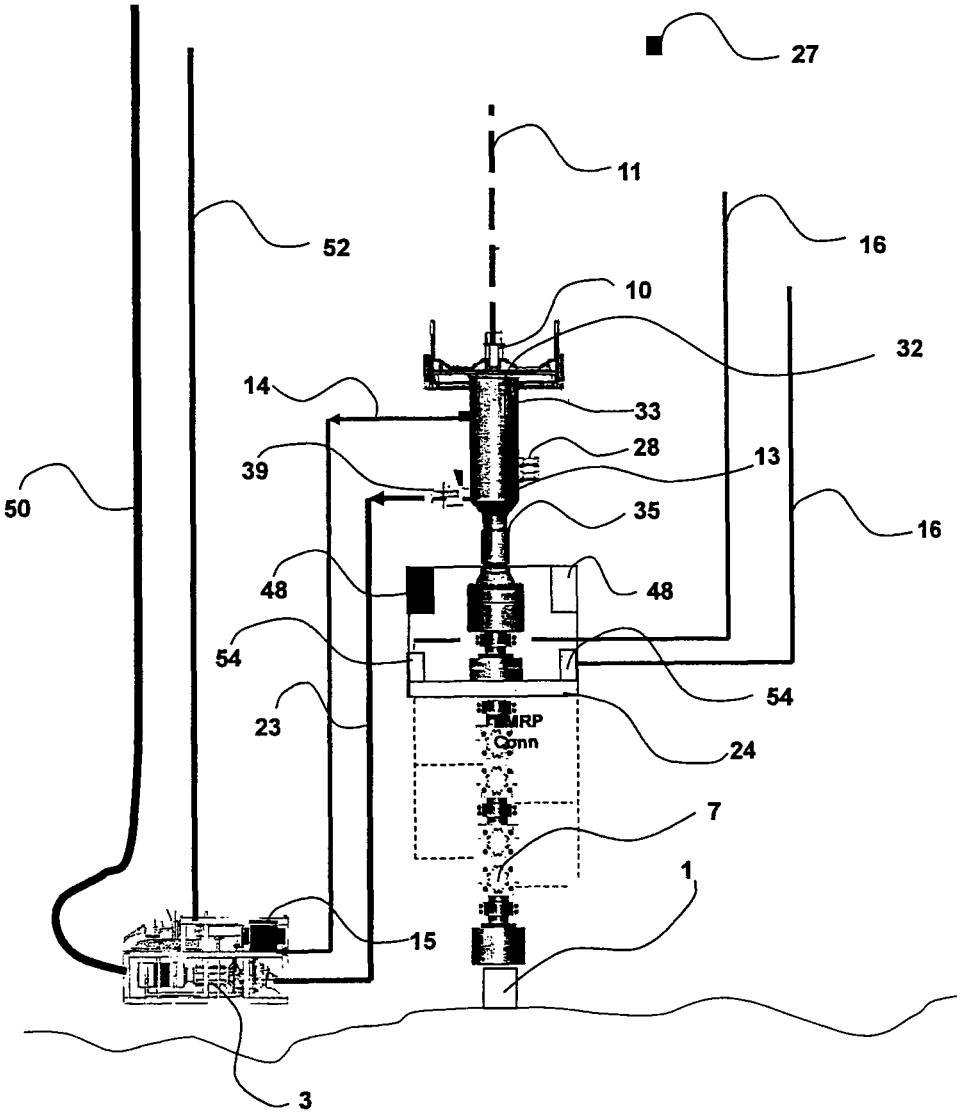
FIG. 3 is an explanatory schematic showing the configuration of a riserless blowout preventer stack for riserless drilling without pollution when tubulars are pulled out or lowered into the riserless blowout preventer stack.

FIG. 3 shows a riserless blowout preventer stack (7) arrangement. This riserless blowout preventer stack (7) has been purposely configured for this arrangement of a riserless drilling system. This detailed description of the stack up commences in the water column and descends downwards through the stack's (7) equipment components.

Since any deployed downhole string (11) has no guidance as in conventional drilling using a marine riser where the marine riser influences and 'guides' bottom hole assemblies as they approach the top of the blowout preventer stack (7) when running in the hole, this riserless embodiment is fitted with a utility/wiper frame (10). The uppermost core component of this stack-up is a drilling fluid recovery funnel (13) which effectively act as the hydraulic de-coupler sustaining full separation between the drilling fluids (26) and the ambient seawater (27), meaning that seawater may leak controlled into the recovery funnel container but drilling fluid will not leak out because the pressure of the recovery funnel container is controlled, by pumping out the contaminated drilling fluid/seawater transition zone fluid from said container so that the pressure therein is lower than or equal to the surrounding seawater pressure. The drilling fluid recovery funnel (13) is fitted with drilling fluid level sensors (28) which maintain the drilling fluid level in the drilling fluid recovery funnel (13) between prescribed limits. The level sensors (28) are connected to the system control system via telemetry cables which can be separately or parallel routed to the drilling fluid suction hose (23) between the riserless blowout preventer stack (7) and subsea booster pump (3) module and the drilling unit MODU (5) via the drilling fluid return hose (50). Visual monitoring of the level of drilling fluid within the drilling fluid recovery funnel (13) is accommodated by the use of a backlit sightglass (33) and a video camera facility. The drilling fluid recovery funnel (13) is fitted with a hydraulic latch assembly (35) which enables disconnection from the lower marine riser package (24) for retrieval to surface for remedial scopes of work.

Other outlets from the drilling fluid recovery funnel (13) comprises:

A drilling fluid suction hose outlet (39) to the subsea booster pump (3) fitted with one or more low pressure shut-off valve(s). From the higher portion of the drilling fluid recovery funnel (13), another outlet is provided, to a zero pollution system (14) and zero pollution pump (15), providing an effective evacuation of any contaminated seawater in close proximity to the drilling fluid/seawater interface.

In the top portion of the drilling fluid recovery funnel (13), a 'J' slot (32) profiling is machined in the ID of the funnel to facilitate the engagement and disengagement of a running and retrieving tool.

The hydraulic power lines for the hydraulic funnel latch (35) mechanism are hard-tubed to stab connectors on the drilling fluid recovery funnel (13) receptacle plate.

Two standard hydraulic piloted control pods (48) will supply the extra hydraulic functions imposed by the re-configuration of the riserless blowout preventer stack (7) for riserless drilling.

The foundation plating for the LMRP is provided in the form of a receiver plate (24), as found in conventional subsea BOP stacks.

The choke line and kill line terminate in goosenecks assemblies (54).

Figure 4:
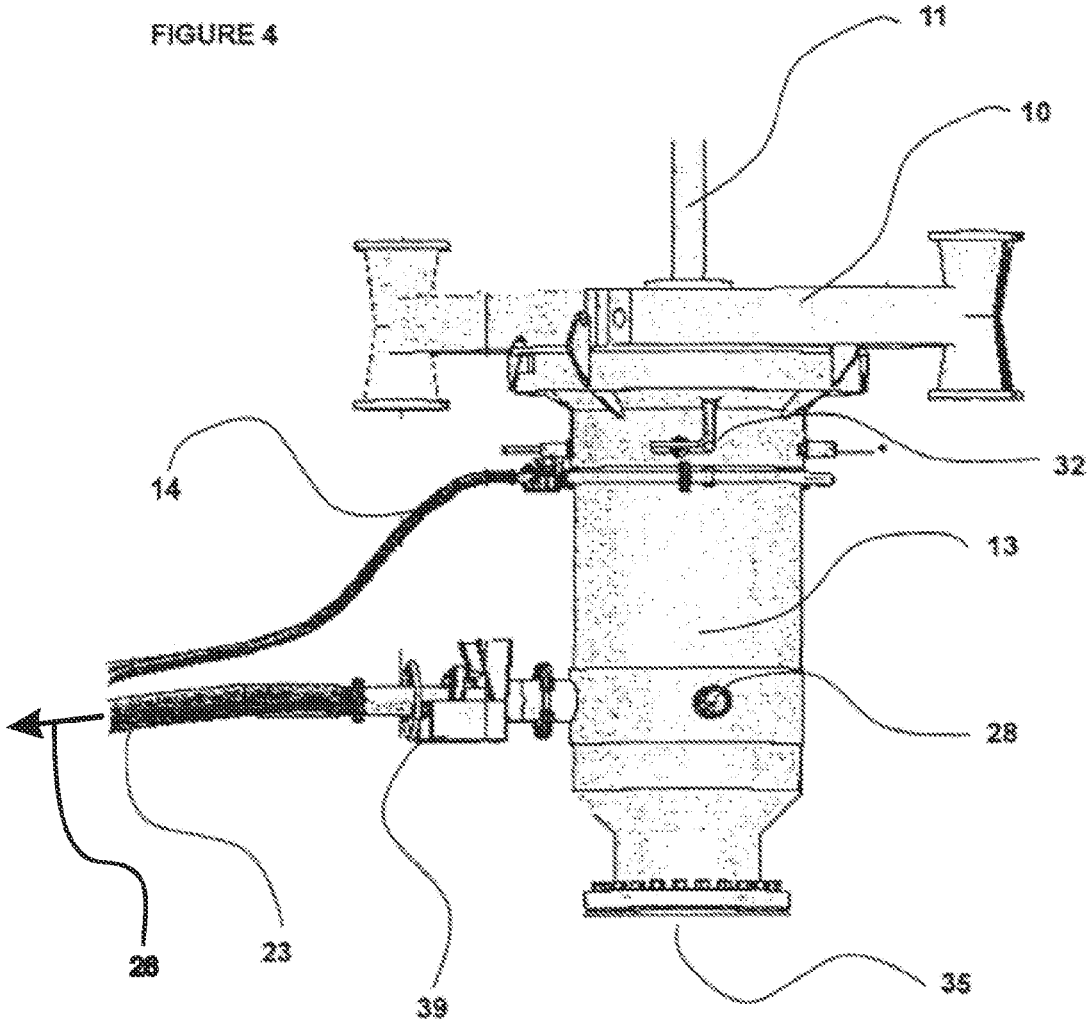
FIG. 4 shows the utility/wiper frame interfacing the drilling fluid recovery funnel.

FIG. 4 shows the drilling fluid recovery funnel (13) with the utility/wiper frame (10) interfaced in order to create a complete zero pollution system (14).

Figure 5:
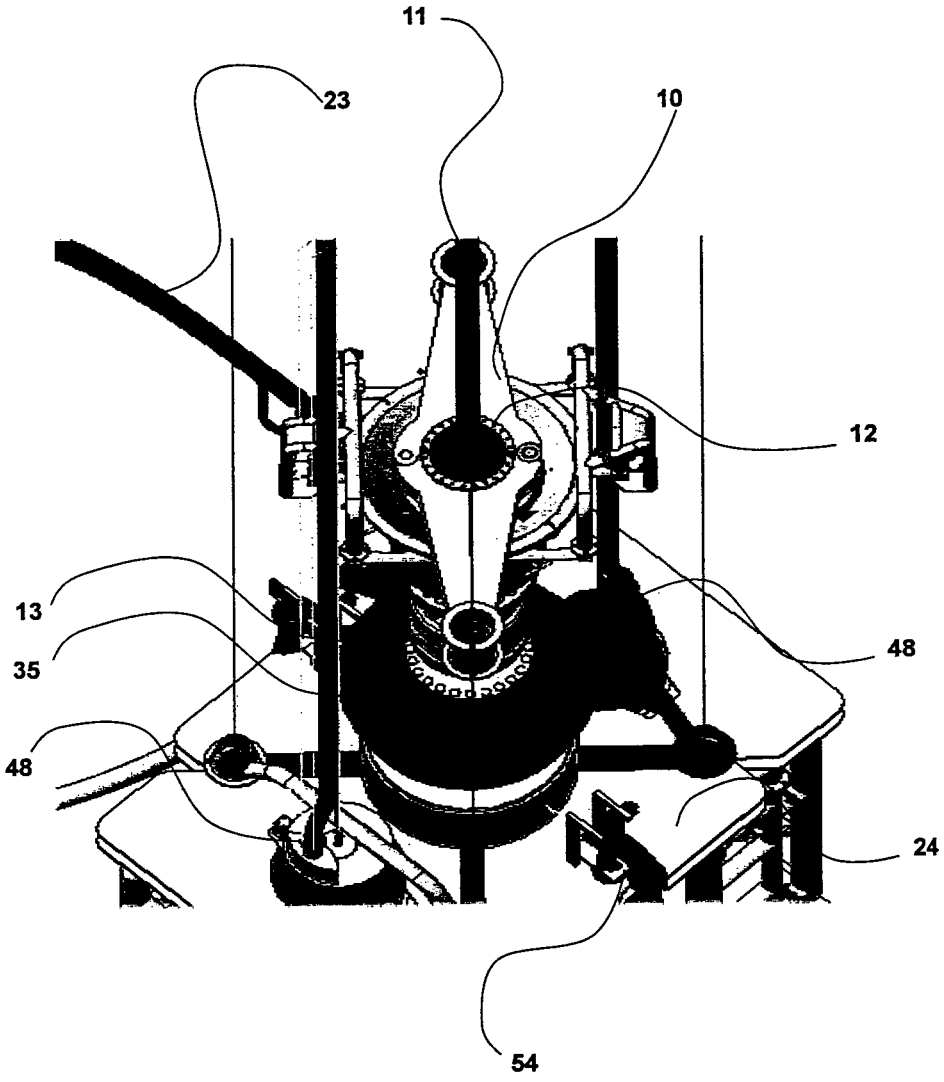
FIG. 5 shows the utility/wiper frame interfacing the drilling fluid recovery funnel and the lower marine riser assembly (LMRP).

FIG. 5 shows the drilling fluid recovery funnel (13) with the utility/wiper frame (10) interfaced and where the drilling fluid recovery funnel (13) is latched to the riserless blowout preventer stack (7) and the lower marine riser package plate (24). The figure shows the tubular wiper assembly (12) as part of the utility/wiper assembly (10) energised in a wiper position, keeping the drilling fluid kept into the drilling fluid recovery funnel (13) and where it is removed by the zero pollution system (14).

The figure also shows that the flexible choke and kill lines (16) is connected to the lower marine riser package stab plate (24) by gooseneck assemblies (54)

Figure 6:
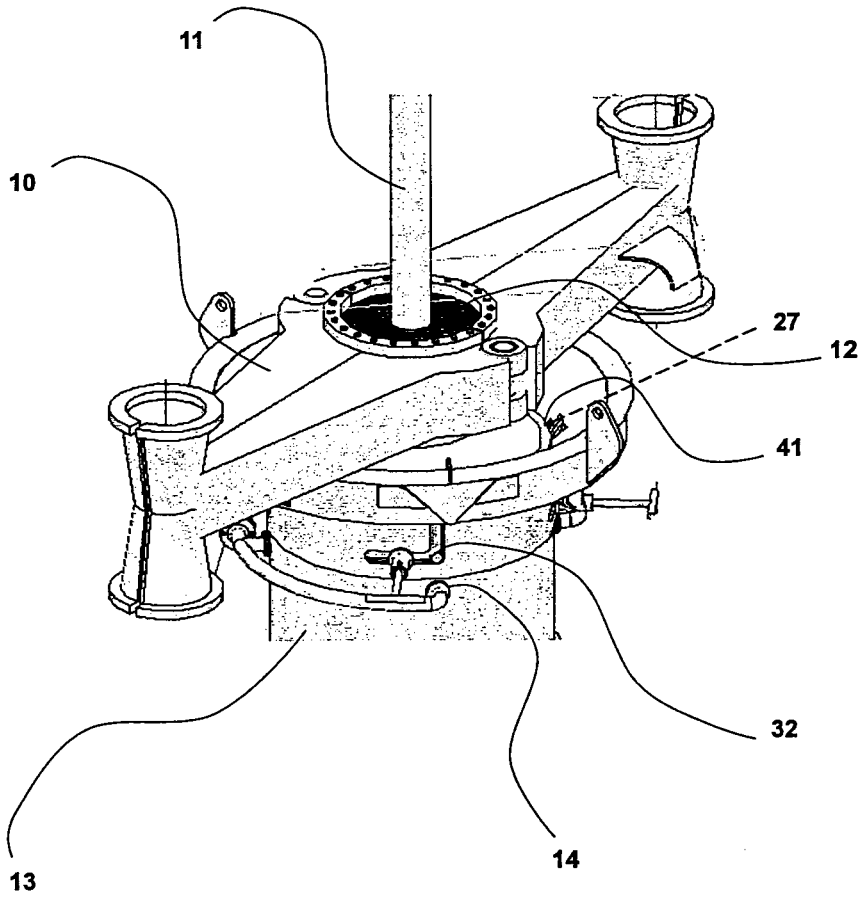
FIG. 6 shows the restricted open interface area between the drilling fluid recovery funnel and the utility/wiper frame for inflow of seawater eliminating contamination when tubulars are handled from the seawater environment to the drilling fluid environment.

FIG. 6 shows the drilling fluid recovery funnel (13) with the utility/wiper frame (10) interfaced and where the tubular wiper assembly (12) is energised in a wiper position, which is a closed wiping position, keeping the drilling fluid inside the drilling fluid recovery funnel (13) and where the interpose seawater/drilling fluid is removed by the zero pollution system (14).

The figure also shows the restricted seawater inflow area (41) where seawater (27) slightly is flowing into the drilling fluid recovery funnel (13) where the zero pollution system (14) is keeping the upper part of the drilling fluid recovery funnel (13) inner bore free of pollution by pumping the contamination away from the recovery funnel (13) by a zero pollution pump (15) and back to the drilling unit MODU (5) for treatment. Pressure control means may also be included in the recover funnel, operatively arranged to the pump control.

Figure 7:
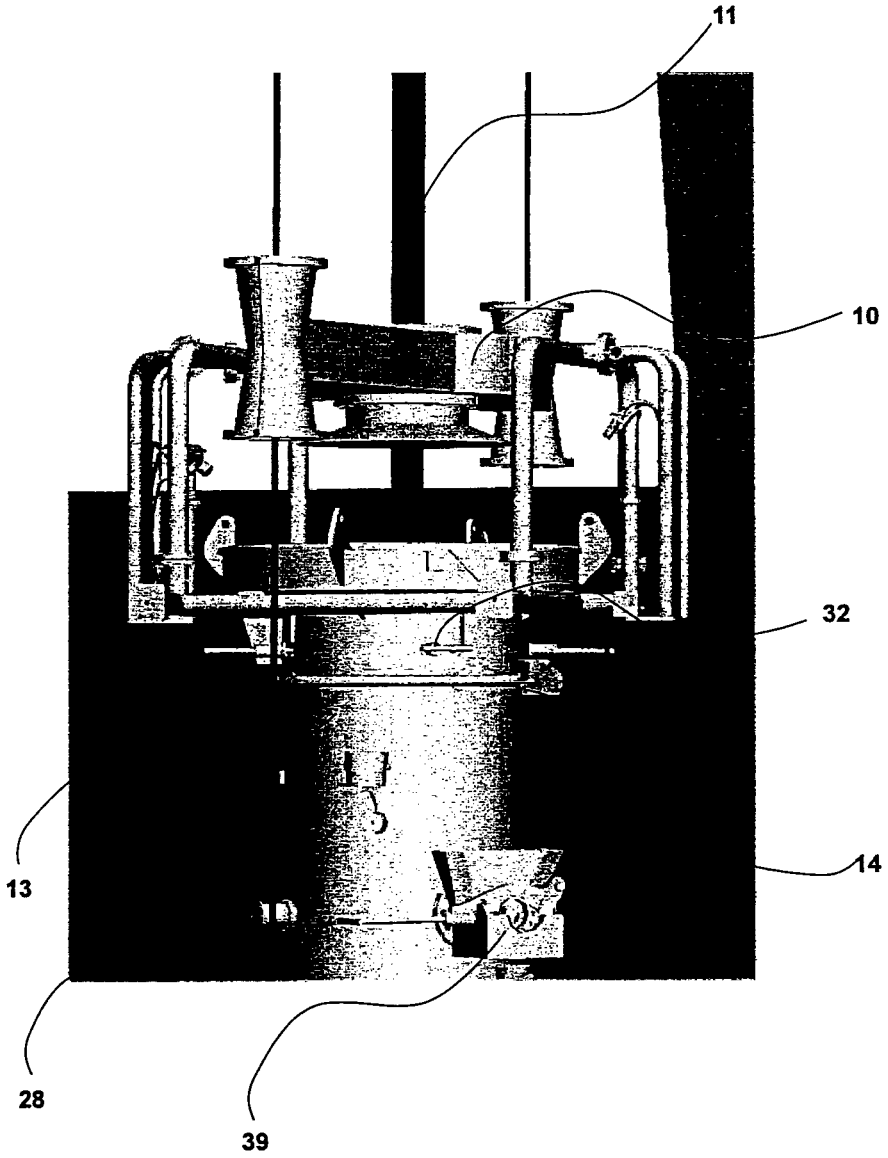
FIG. 7 shows the utility/wiper frame, for clarity, lifted off the drilling fluid recovery funnel

FIG. 7 for clarity shows the utility/wiper frame(10) in the process of landing out on the top of the mud recovery funnel (13) in order to create a complete zero pollution system (14).

The invention claimed is:

1. Drilling system for drilling subsea wells from a floating mobile offshore drilling unit (MODU), the system comprising:

a subsea BOP attached to a well below a seabed, the BOP not being connected to the MODU by a marine riser;

flexible choke and kill lines arranged between the subsea BOP and the MODU;

a drill string guiding and cleaning apparatus, configured for guiding a drill string when inserting or taking out the drill string from the well, the guiding and cleaning apparatus being further configured for drill string cleaning when pulling the drill string out from the well;

a recovery funnel arranged below the drill string guiding and cleaning apparatus, but above the well;

a seawater leakage control system configured for pressure control that enables controlled leakage of seawater into the recovery funnel while inhibiting polluted seawater from flowing out of the recovery funnel; and a fluid return system configured for return from the recovery funnel to the MODU of drilling fluid and seawater leaked into the recovery funnel, said fluid return system including separate drilling fluid and polluted water outlet lines extending from the recovery funnel, said outlet lines being in fluid communication with separate drilling fluid and polluted water pumps and return lines.

2. System according to claim 1, wherein the seawater leakage control system includes a seawater leak-in slot and a drilling fluid level control apparatus, the drilling fluid level control apparatus being arranged for mud level control in the recovery funnel, and thereby also pressure control in the recovery funnel, so that the pressure in the recovery funnel is maintained equal to or slightly lower than the outside seawater pressure proximal to the recovery funnel, thereby allowing a controlled leakage of seawater into the recovery funnel.

3. System according to claim 1, wherein the recovery funnel is a compartment on top of the BOP that is configured to receive drilling fluid and leaked in seawater, the recovery funnel including a level and pressure control system comprising at least one pressure sensor, the level and pressure control system being configured for controlling a drilling fluid/seawater level in the recovery funnel to be between a high and a low level, and for maintaining a pressure within the recovery funnel to be equal to or lower than the pressure of the surrounding seawater.

4. System according to claim 1, wherein the drill string guiding and cleaning apparatus includes a guiding part arranged on the drill string and a wiper part that can be closed around the drill string for wiper operation, said guiding and wiper parts constituting a utility wiper frame.

* * * * *